US008336978B2

(12) United States Patent
Uezawa

(10) Patent No.: US 8,336,978 B2
(45) Date of Patent: Dec. 25, 2012

(54) HEATING FLOW PATH UNIT AND LIQUID EJECTING HEAD

(75) Inventor: Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/236,499

(22) Filed: Sep. 19, 2011

(65) Prior Publication Data

US 2012/0069098 A1 Mar. 22, 2012

(30) Foreign Application Priority Data

Sep. 21, 2010 (JP) ..... 2010-210517

(51) Int. Cl.
*B41J 29/38* (2006.01)
*B41J 2/175* (2006.01)

(52) U.S. Cl. ..... 347/6; 347/17; 347/85

(58) Field of Classification Search ..... None
See application file for complete search history.

(56) References Cited

U.S. PATENT DOCUMENTS 8,157,355 B2 * 4/2012 Akahane ..... 347/56
2009/0073234 A1 3/2009 Akahane

FOREIGN PATENT DOCUMENTS

JP 2009-083470 4/2009

* cited by examiner

*Primary Examiner* — Geoffrey Mruk
(74) *Attorney, Agent, or Firm* — Workman Nydegger

(57) ABSTRACT

In the heating flow path unit, the entrance-side sealing member has an inflow restriction portion which restricts flow of liquid on a portion corresponding to an individual entrance-side opening of a liquid flow path in which flow rate is relatively high among the liquid flow paths.

6 Claims, 9 Drawing Sheets

HEATING FLOW PATH UNIT AND LIQUID EJECTING HEAD

The entire disclosure of Japanese Patent Application No: 2010-210517, filed Sep. 21, 2010 is expressly incorporated by reference herein.

BACKGROUND

1. Technical Field

The present invention relates to a heating flow path unit which is mounted on a liquid ejecting head such as an ink jet recording head and a liquid ejecting head including the heating flow path unit. In particular, the invention relates to a heating flow path unit having a plurality of liquid flow paths which are arranged in parallel and a liquid ejecting head including the heating flow path unit.

2. Related Art

As a representative liquid ejecting head, for example, an ink jet recording head (hereinafter, referred to as recording head) which is mounted on an ink jet printer (one type of liquid ejecting apparatus, hereinafter, referred to as printer) can be exemplified. The ink jet printer performs recording by discharging and landing ink in a liquid form onto a recording medium (ejected target) such as a recording paper. Further, the liquid ejecting heads are used for ejecting various types of liquids other than ink. For example, a color material used for a color filter such as a liquid crystal display, an organic material used for an organic Electro Luminescence (EL) display, an electrode material used for forming an electrode, and the like are ejected from the liquid ejecting heads.

In recent years, photocurable ink which is cured with irradiation of light energy such as ultraviolet rays is used when an image or the like is printed in some case. The photocurable ink is cured and fixed to even a recording medium having poor ink absorbency by irradiating the photocurable ink with light. Therefore, the photocurable ink is used for recording an image onto a resin film, for example, and other various applications. However, the photocurable ink tends to have viscosity higher than that of common aqueous ink. For example, the viscosity of the aqueous ink at a normal temperature (for example, 25° C.) is lower than 8 mPa·s. On the other hand, the viscosity of the photocurable ink at the normal temperature is equal to or higher than 8 mPa·s. The viscosity of the ink is required to be made lower in order for such ink in a so-called high viscosity range to be ejected by the liquid ejecting head. Therefore, there has been proposed a liquid ejecting head which is configured to eject ink onto a recording medium after the viscosity of the ink has been made lower to a viscosity suitable for being ejected by heating the ink with a heating unit such as a heater (for example, see JP-A-2009-083470).

In the invention as disclosed in JP-A-2009-083470, a heating flow path unit having a liquid flow portion which allows communication between flow paths of a liquid supply source (self-sealing valve) and a recording head is provided therebetween. Further, in the invention as disclosed in JP-A-2009-083470, ink passing through the liquid flow portion is heated with a heater so as to lower viscosity of the ink. A main body (base body) of the heating flow path unit is a hollow block member formed by a material having high heat conductivity such as a metal. An internal space of the main body is divided by dividing walls so that a plurality of liquid flow portions are formed in parallel. With this configuration, heat from the heater is transferred to the ink flowing through the liquid flow portions through the unit base body including the dividing walls. With this configuration, ink can be heated while suppressing a flow path resistance and a pressure loss from increasing.

Flow rates of inks flowing through the plurality of liquid flow paths which are formed in parallel are not necessarily constant depending on a position of an opening of a flow path provided at the upstream side or the downstream side with respect to the liquid flow paths. That is, a flow rate of ink flowing through the liquid flow portion formed at a position close to the opening of the flow path provided at the upstream side or the downstream side is relatively high. On the other hand, a flow rate of ink flowing through the liquid flow portion formed at a position distanced from the opening of the flow path provided at the upstream side or the downstream side is relatively low. In general, the liquid flow portion formed at a center portion among the liquid flow portions is the closest to the opening of the flow path provided at the upstream side or the downstream side. Therefore, a flow rate of ink flowing through the liquid flow portion formed at the center portion is higher than flow rates of inks flowing through the liquid flow portions formed at ends. As the flow rate is higher, time taken for ink to pass through the liquid flow portion becomes shorter. Therefore, there has arisen a problem that ink passing through the liquid flow portion in which flow rate is high is hard to be heated sufficiently.

SUMMARY

An advantage of some aspects of the invention is to provide a heating flow path unit which can efficiently heat liquid while flow rates of liquids flowing through a plurality of liquid flow paths are made constant and a liquid ejecting head including the heating flow path unit.

A heating flow path unit according to an aspect of the invention which is arranged between a liquid supply source and a liquid ejecting head and heats liquid to be supplied to the side of the liquid ejecting head by a heater includes a plurality of liquid flow paths which are formed so as to be in parallel in a direction intersecting with a flowing direction of liquid in a unit base body and allows communication between a supply flow path from the side of the liquid supply source and an introduction flow path to the side of the liquid ejecting head, and an entrance-side sealing member which is arranged between a peripheral edge portion of an exit-side opening at the side of the supply flow path and a peripheral edge portion of a common entrance-side opening which is common to the liquid flow paths and connects the exit-side opening at the side of the supply flow path and the common entrance-side opening in a liquid-tight state. The entrance-side sealing member has an inflow restriction portion which restricts flow of liquid on a portion corresponding to an individual entrance-side opening of a liquid flow path in which flow rate is relatively high among the liquid flow paths.

With the above configuration, the entrance-side sealing member has an inflow restriction portion which restricts flow of liquid on a portion corresponding to an individual entrance-side opening of a liquid flow path in which flow rate is relatively high. Therefore, the flowing direction of liquid flowing out from the exit-side opening at the side of the supply flow path is once changed to a plane direction of the entrance-side sealing member by the inflow restriction portion, and then, the liquid flows into each of the liquid flow paths. With this, the liquid from the exit-side opening at the side of the supply flow path becomes difficult to flow into the liquid flow path which is arranged at a position closer to the exit-side opening and in which flow rate tends to be relatively high. On the other hand, the liquid becomes relatively easy to flow into the liquid flow path which is arranged at a position distanced from the exit-side opening at the side of the supply flow path. With this, differences in flow rates of liquids flowing through the liquid flow paths are reduced. Therefore, the temperature of the heater is not required to be set higher more than necessary and the liquid can be efficiently heated.

In the above configuration, it is preferable that the inflow restriction portion be arranged so as to be separated from the individual entrance-side opening in a state where liquid does not flow through the liquid flow paths and be closer to or be separated from the individual entrance-side opening in accordance with a flow rate of liquid.

With this configuration, the inflow restriction portion is arranged so as to be separated from the individual entrance-side opening in a state where liquid does not flow through the liquid flow paths and is closer to or is separated from the individual entrance-side opening in accordance with a flow rate of liquid. Therefore, when a flow rate of liquid on the entire liquid flow path is relatively low, the inflow restriction portion is positioned to be slightly separated from the individual entrance-side opening of the liquid flow path in which flow rate is relatively high. On the other hand, when a flow rate of liquid on the entire liquid flow path is relatively high, the inflow restriction portion is pushed by the flow of the liquid so as to be closer to the individual entrance-side opening of the liquid flow path in which flow rate is relatively high. That is to say, in a case of a so-called low-DUTY in which a consumption amount of liquid on the liquid ejecting head per unit time is relatively small, liquid is easy to flow into the liquid flow path in which flow rate is relatively high. On the other hand, in a case of a so-called high-DUTY in which a consumption amount of liquid on the liquid ejecting head per unit time is relatively large, liquid is difficult to flow into the liquid flow path in which flow rate is relatively high. Therefore, differences in flow rates of liquids flowing through the liquid flow paths are further reduced regardless of levels of the entire ink flow rate. Accordingly, liquid can be heated more efficiently.

Further, in the above configuration, it is preferable that the heating flow path unit further include an exit-side sealing member which is arranged between a peripheral edge portion of a common exit-side opening which is common to the liquid flow paths and a peripheral edge portion of an entrance-side opening at the side of the introduction flow path and connects the common exit-side opening and the entrance-side opening at the side of the introduction flow path in a liquid-tight state, and the exit-side sealing member have an outflow restriction portion which restricts the flow of liquid on a portion corresponding to an individual exit-side opening of a liquid flow path in which flow rate is relatively high among the liquid flow paths.

With this configuration, flow of liquid flowing through the liquid flow path in which flow rate is relatively high among the liquid flow paths can be restricted by the outflow restriction portion of the exit-side sealing member. Therefore, flows of liquids flowing through the liquid flow paths can be controlled by the inflow restriction portion of the entrance-side sealing member and the outflow restriction portion of the exit-side sealing member.

A liquid ejecting head according to another aspect of the invention which introduces liquid from a liquid supply source through an introduction flow path and is capable of ejecting the introduced liquid, includes the heating flow path unit having the above configuration in a detachable manner.

With the above configuration, liquid at a stable temperature is supplied from the heating flow path unit regardless of a liquid consumption amount per unit time. Therefore, variations in ejection characteristics such as an amount of liquid ejected through the nozzles and flight speed are suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a mode for carrying out the invention is described with reference to accompanying drawings. In the embodiments to be described below, various limitations are made as preferable specific examples according to the invention. However, the scope of the invention is not limited to the modes unless otherwise description for limiting the invention is specially made in the following description. Further, in the embodiment, an ink jet recording head (hereinafter, referred to as recording head) is described as an example of a liquid ejecting head.

Figure 1:
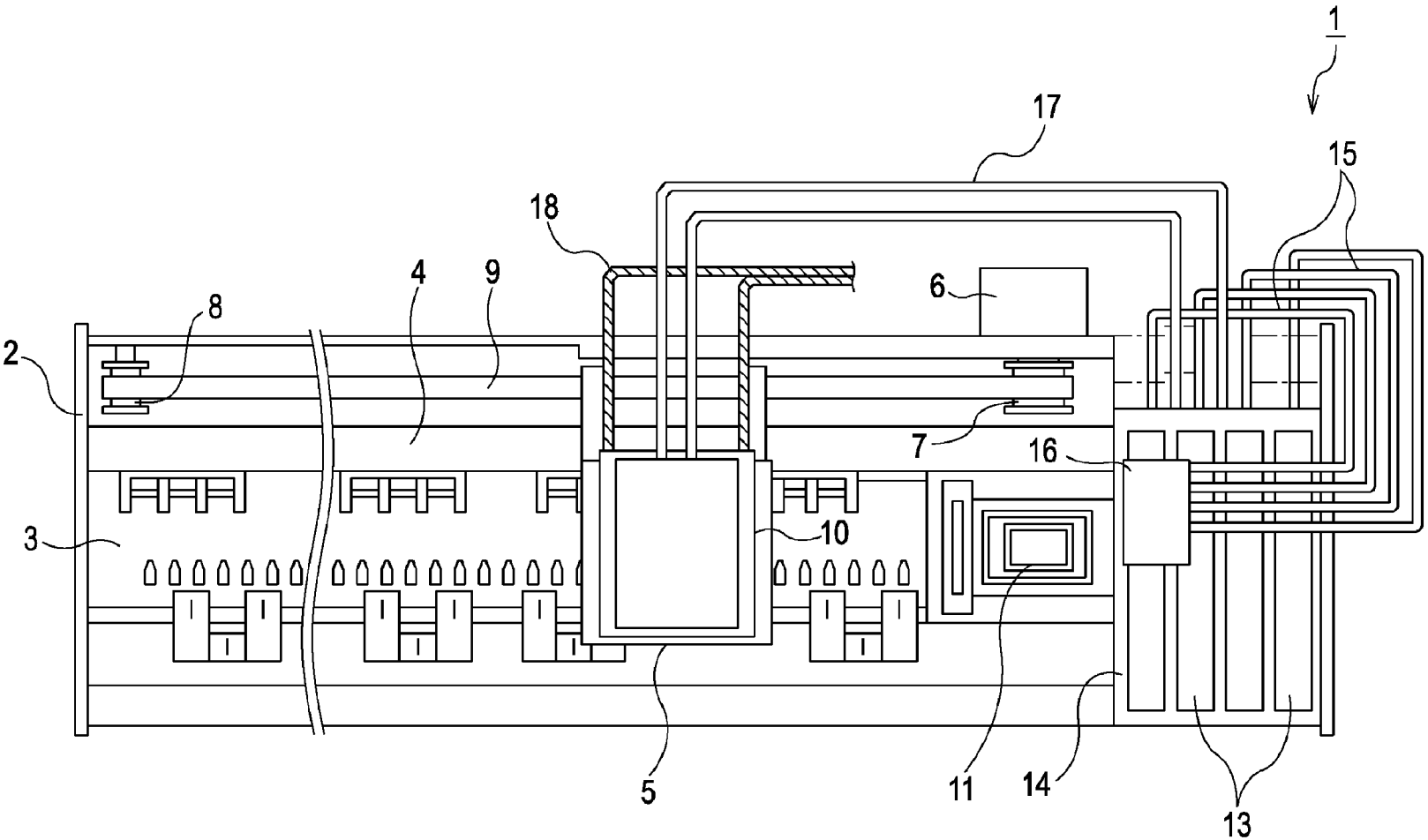
FIG. 1 is a plan view illustrating a configuration of a printer.

FIG. 1 is a plan view illustrating a configuration of an ink jet recording apparatus (hereinafter, referred to as printer) on which a recording head 10 (FIG. 2) is mounted. A printer 1 illustrated as an example is an apparatus which performs recording of an image and the like by ejecting ink in a liquid form (corresponding to liquid according to the invention) onto a surface of a recording medium (landed target, not illustrated) such as a recording paper. The printer 1 includes a frame 2 and a platen 3 arranged in the frame 2. In the printer 1, a recording paper is transported onto the platen 3 by a paper feeding roller which rotates by a paper feeding motor driving. Note that any of the paper feeding roller and the paper feeding motor are not illustrated in FIG. 1. Further, a guide rod 4 is bridged in the frame 2 so as to be in parallel with the platen 3. A carriage 5 which accommodates the recording head 10 is supported onto the guide rod 4 in a slidable manner. The carriage 5 is connected to a timing belt 9 which is stretched between a driving pulley 7 and an idling pulley 8. The driving pulley 7 rotates by a pulse motor 6 driving. The idling pulley 8 is provided at the side opposite to the driving pulley 7 in the frame 2. Further, the carriage 5 is configured so as to reciprocate in a main scanning direction perpendicular to a paper feeding direction along the guide rod 4 by driving the pulse motor 6.

A cartridge holder 14 is provided at one side of the frame 2. Ink cartridges 13 are mounted on the cartridge holder 14 in a detachable manner. The ink cartridges 13 are connected to an air pump 16 through air tubes 15. Air from the air pump 16 is supplied to each of the ink cartridges 13. Further, inner portions of the ink cartridges 13 are pressurized by the air so that ink is supplied (pressure-fed) to the side of the recording head 10 through ink supply tubes 17.

The ink supply tubes 17 are hollow members having flexibility, which are formed by a synthetic resin such as silicone, for example. Ink flow paths corresponding to the ink cartridges 13 are formed in the ink supply tubes 17. Further, flexible flat cables (FFCs) 18 are wired between a main body of the printer 1 and the recording head 10. The FFCs 18 transmit a driving signal and the like from a controller (not illustrated) in the main body of the printer 1 to the recording head 10.

Figure 2:
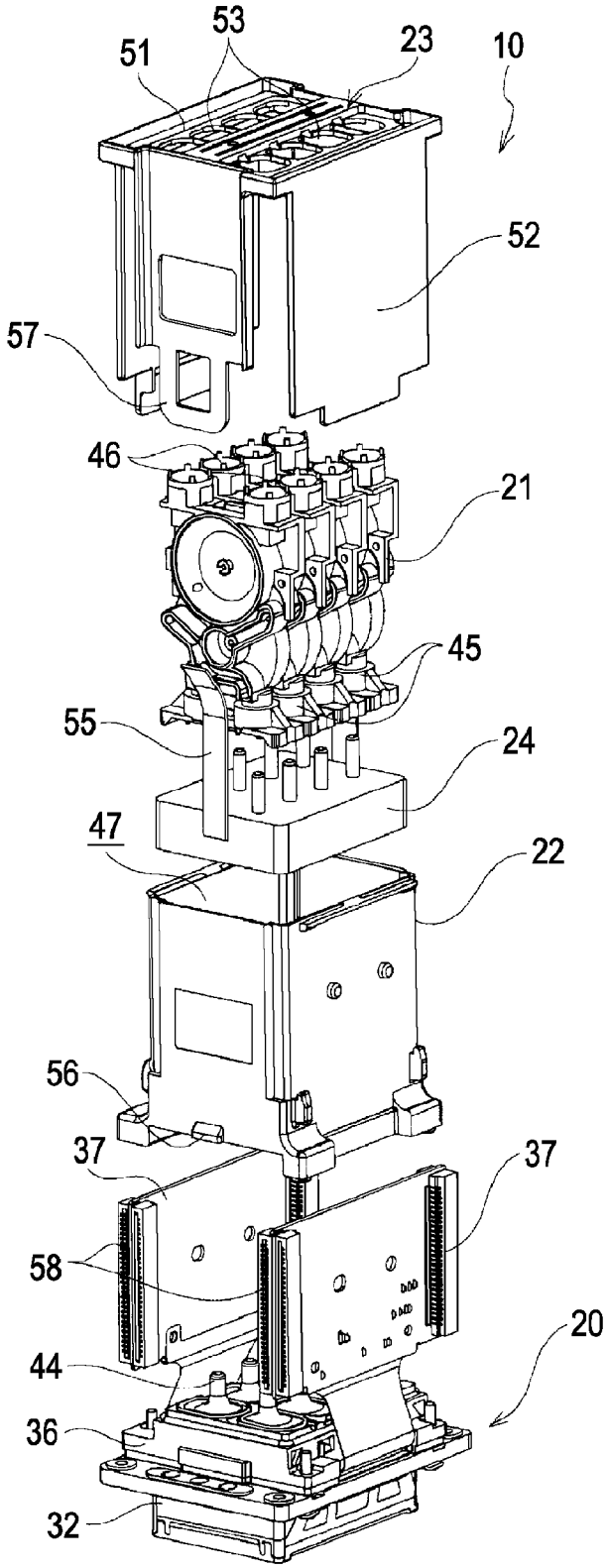
FIG. 2 is an exploded perspective view illustrating a configuration of a recording head.
Figure 3:
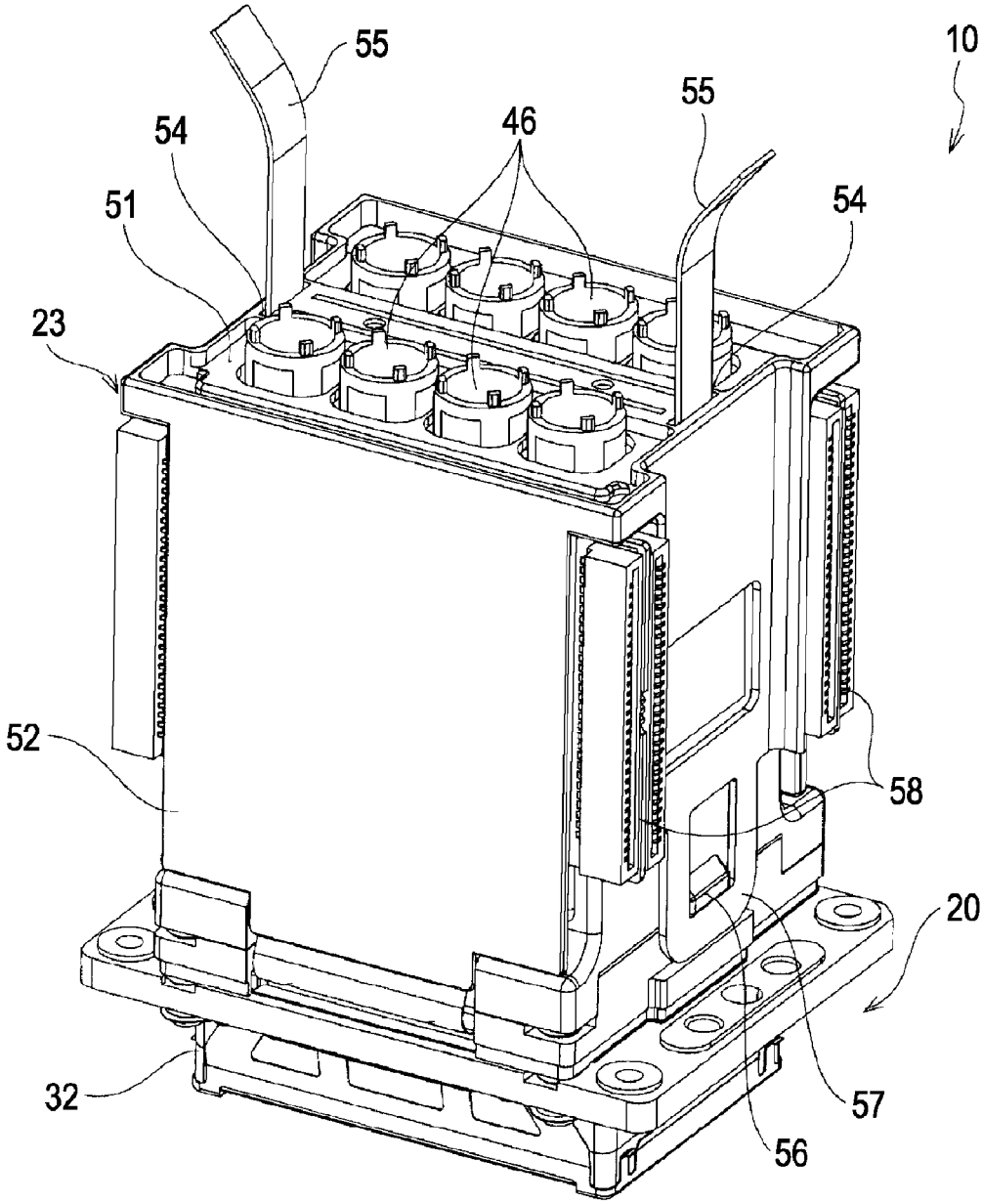
FIG. 3 is a perspective view illustrating the recording head.
Figure 4:
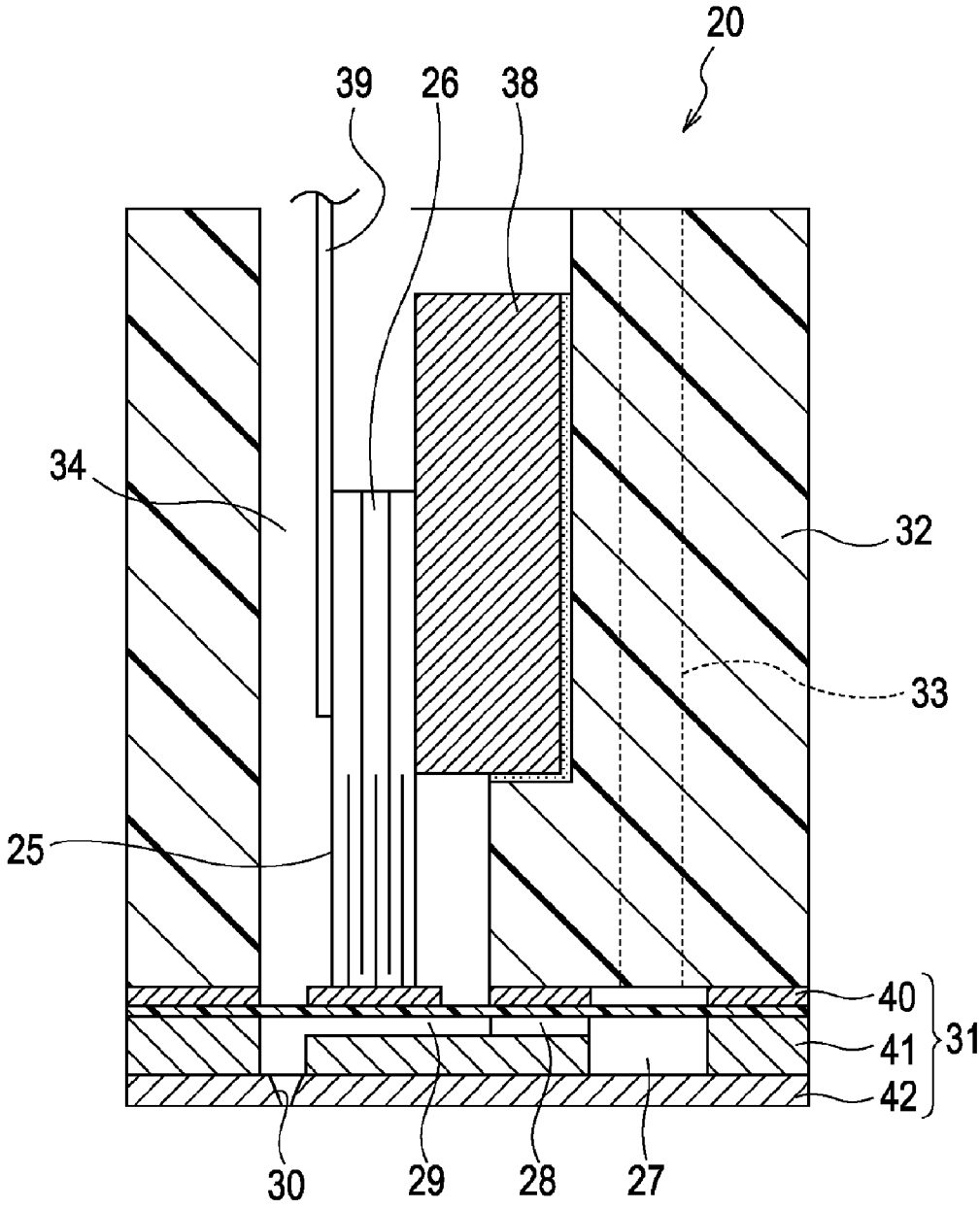
FIG. 4 is a cross-sectional view illustrating the main portion of a head unit.

FIG. 2 and FIG. 3 are views for explaining a configuration of the recording head 10 in the embodiment. FIG. 2 is an exploded perspective view illustrating the recording head 10. FIG. 3 is a perspective view illustrating the recording head 10. FIG. 4 is a cross-sectional view illustrating the main portion of a head unit 20.

The recording head 10 in the embodiment includes the head unit 20, sub tanks 21 (one type of a liquid supply source according to the invention), an inner case 22, an outer case 23, and a heating flow path unit 24 as the main constituent components.

The above head unit 20 is schematically configured to include actuator units 26, a flow path unit 31, a head case 32, and the like. Each actuator unit 26 includes a plurality of piezoelectric vibrators 25. The flow path unit 31 forms a series of ink flow path from common ink chambers (also referred to as reservoirs or manifolds) to nozzles 30 through ink supply ports 28 and pressure chambers 29.

The head case 32 is a hollow casing having a box shape. Case flow paths 33 and accommodation chambers 34 are formed in the head case 32. The case flow paths 33 are flow paths for introducing ink from the side of the sub tanks 21 and the heating flow path unit 24 to the side of the common ink chambers 27. Each accommodation chamber 34 accommodates each actuator unit 26 individually. The head case 32 is molded by an epoxy resin as one type of thermosetting resins. The flow path unit 31 is fixed to a flow path attachment face (lower face) of the head case 32. Further, an introduction needle unit 36 (see, FIG. 2) is attached to a base end face (upper face) of the head case 32 at the opposite side to the flow path attachment face.

Each of the above actuator units 26 is constituted by piezoelectric vibrators 25 as pressure generation units, a fixing plate 38, a flexible cable 39, and the like. The fixing plate 38 is made of a metal and the piezoelectric vibrators 25 are bonded to the fixing plate 38. The flexible cable 39 applies a driving signal from driving substrates 37 to the piezoelectric vibrators 25. Each piezoelectric vibrator 25 is attached onto the fixing plate 38 made of a metal plate material such as stainless steel in a so-called cantilever state where a free end thereof projects to an outer side with respect to a front end face of the fixing plate 38. It is to be noted that as the pressure generation units, electrostatic actuators, magnetostrictive elements, heat generation elements, or the like other than the above piezoelectric vibrators can be used.

The flow path unit 31 is formed by bonding flow path unit constituent members including a vibration plate 40, a flow path substrate 41, and a nozzle substrate 42 in a laminated state and integrating the flow path unit constituent members. The pressure chambers 29 on the flow path unit 31 are formed as chambers elongated in the direction perpendicular to the direction that the nozzles 30 are arranged in a row (nozzle row direction). Further, the common ink chambers 27 are chambers to which inks are introduced from the side of the sub tanks 21 through the heating flow path unit 24. The inks introduced to the common ink chambers 27 are distributed and supplied to each pressure chamber 29 through each ink supply port 28.

The nozzle substrate 42 arranged on the bottom of the flow path unit 31 is a thin plate material made of a metal on which a plurality of nozzles 30 are opened in a row at a pitch corresponding to dot formation density. The nozzle substrate 42 according to the embodiment is formed by a plate material of stainless steel. A plurality of nozzle rows (one type of nozzle group) are provided so as to be lined in the scanning direction (main scanning direction) of the recording head 10. The plurality of nozzles 30 are arranged in a row on each nozzle row. Further, one nozzle row is constituted by 360 nozzles 30, for example.

The introduction needle unit 36 is arranged on the base end face (face at the opposite side to the nozzle formation face) of the head case 32. The introduction needle unit 36 is molded by a synthetic resin or the like. A plurality of ink introduction needles 44 are attached to an upper face of the introduction needle unit 36 in a state where a filter (not illustrated) is interposed therebetween. Further, the heating flow path unit 24, which will be described later, is mounted on the upper face of the introduction needle unit 36 in a detachable manner. If the heating flow path unit 24 is mounted on the introduction needle unit 36, the ink introduction needles 44 are inserted into the heating flow path unit 24. Further, a converging flow path (not illustrated) corresponding to each ink introduction needle 44 is formed in the introduction needle unit 36. The converging flow paths communicate with the case flow paths 33 in the head case 32 so as to supply inks introduced from the ink introduction needles 44 to the side of the pressure chambers through the case flow paths 33. It is to be noted that a flow path from the ink introduction needles 44 to the common ink chambers 27 through the case flow paths 33 including lead-out flow paths of second flow path connection joints, which will be described later, corresponds to an introduction flow path according to the invention.

The ink supply tubes 17 from the side of the printer main body are connected to flow path connecting portions 46 which are formed on upper faces of the above sub tanks 21. The sub tanks 21 receive ink from the ink supply tubes 17 and introduce the ink to the side of the pressure chambers after adjusting a supply pressure of the ink. In the embodiment, four sub tanks 21 in total are accommodated in the inner case 22. Two flow paths are formed in one sub tank 21 so as to correspond to two types of inks. Further, insertion portions 45 are provided on bottoms of the sub tanks 21. Cylindrical portions 72*b* (see, FIG. 6) of first flow path connection joints 72 of the heating flow path unit 24 are inserted into the insertion portions 45.

Further, each sub tank 21 opens and closes a valve in accordance with pressure fluctuation in the sub tank 21 so as to control supply of ink to the side of the head unit 20. That is to say, in a non-recording state where the recording head 10 does not eject ink (ink is not consumed), the sub tanks 21 close the valves such that ink is not supplied to the side of the recording head 10. On the other hand, if the recording head 10 ejects ink at the time of a recording operation (ejecting operation) to consume the ink so that pressures in pressure adjustment chambers in the sub tanks 21 are lowered, the sub tanks 21 open valves so that ink is supplied to the side of the recording head 10.

The above inner case 22 is a sleeve-form member of which upper and lower faces are opened. The inner case 22 is attached to an upper face side of the head unit 20 in a state of surrounding the ink introduction needles 44. Planar shapes of the openings of the inner case 22 are formed into substantially rectangular shapes. An internal space of the inner case 22 corresponds to an accommodation hollow portion 47 which accommodates the heating flow path unit 24 and the sub tanks 21. Further, driving substrates 37 are attached to outer faces of the inner case 22.

The above outer case 23 is a member having a cross section of a substantially gate shape. The outer case 23 is formed by a base face 51 and side wall portions 52. The base face 51 is capable of covering the upper opening of the inner case 22. The side wall portions 52 extend downward (to the side of the head unit 20) from both side edges of the base face 51 in the direction perpendicular to the direction that the sub tanks are arranged in a row. The side wall portions 52 function as substrate covering walls which cover the driving substrates 37 fixed to the side faces of the inner case 22. Openings 53 which make it possible to expose the flow path connecting portions 46 are provided on the base face 51 at portions corresponding to the flow path connecting portions 46 on the sub tanks 21 accommodated in the accommodation hollow portion 47 (FIG. 2). Further, slits 54 are formed on both edges of the base face 51 in the direction that the sub tanks are arranged in a row. Lead wires 55 of the heating flow path unit 24 accommodated in the inner case 22 are drawn out to the outside of the head through the slits 54 (FIG. 3).

Further, locked portions 57 are formed on the base face 51 of the outer case 23. The locked portions 57 are formed downward from both side edges of the base face 51 in the direction that the sub tanks are arranged in a row. Locking claws 56 of the inner case 22 can be engaged with the locked portions 57. If the outer case 23 is attached to the inner case 22, the locking claws 56 of the inner case 22 are engaged with through-holes of the locked portions 57. With this, the outer case 23 is fixed to the inner case 22.

Further, the inner case 22 is attached to the head unit 20 in a state of surrounding the ink introduction needles 44 of the introduction needle unit 36. Then, the heating flow path unit 24 and the sub tanks 21 are sequentially accommodated in the accommodation hollow portion 47 of the inner case 22 and the driving substrates 37 are fixed to the side faces of the inner case 22. In addition, the outer case 23 is attached to the outer side of the inner case 22 so that the upper opening of the accommodation hollow portion 47 and the driving substrates 37 on the side faces of the inner case 22 are covered by the outer case 23. At this time, the flow path connecting portions 46 of the sub tanks 21 are exposed from the openings 53 and the lead wires 55 are drawn out from the slits 54. It is to be noted that in the covering state, connectors 58 of the driving substrates 37 are exposed and the FFCs 18 at the side of the printer main body are connected to the connectors 58.

Next, the heating flow path unit 24 is described.

Figure 5:
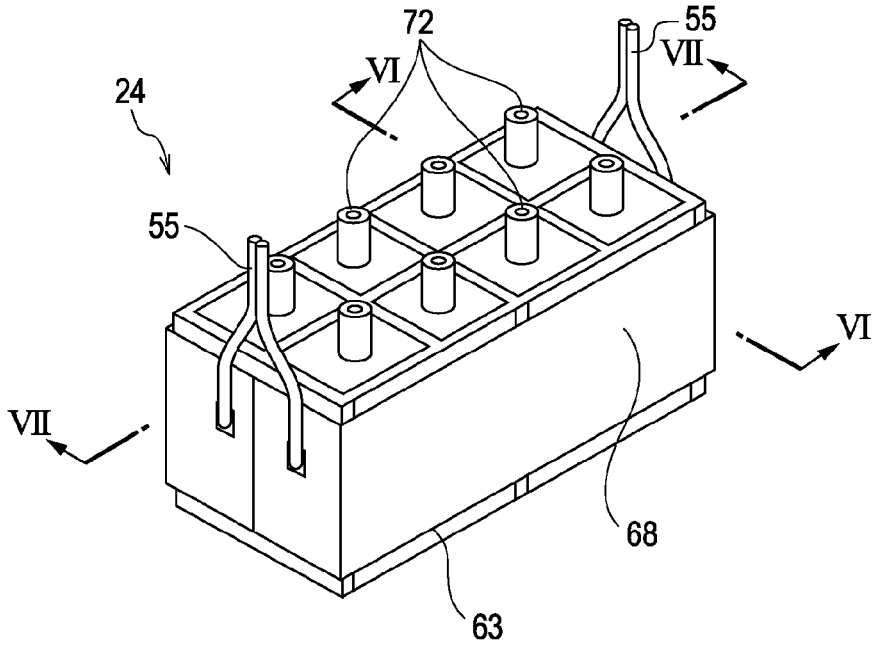
FIG. 5 is a perspective view illustrating a heating flow path unit.
Figure 6:
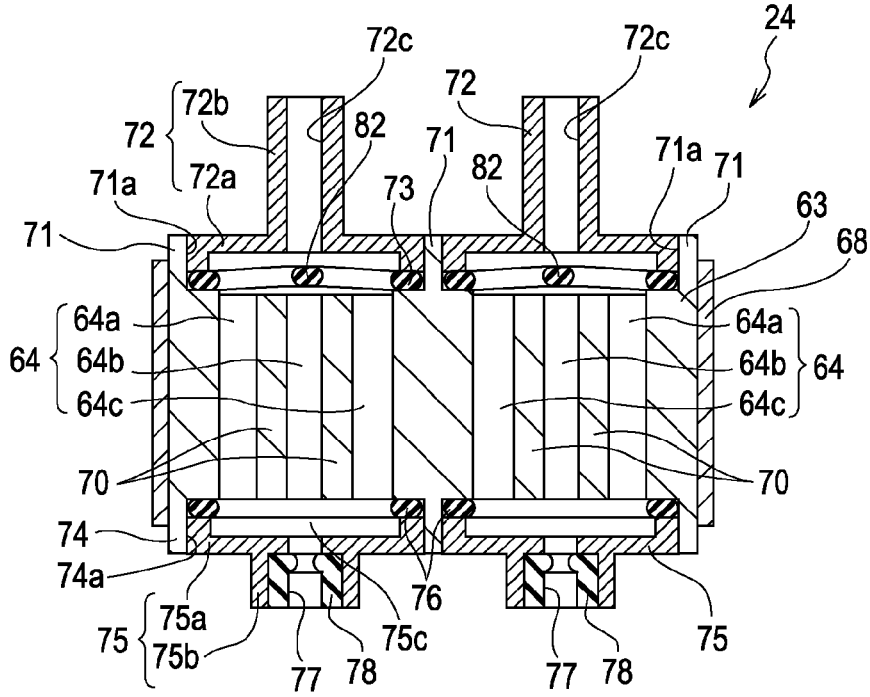
FIG. 6 is a cross-sectional view cut along a line VI-VI in FIG. 5.
Figure 7:
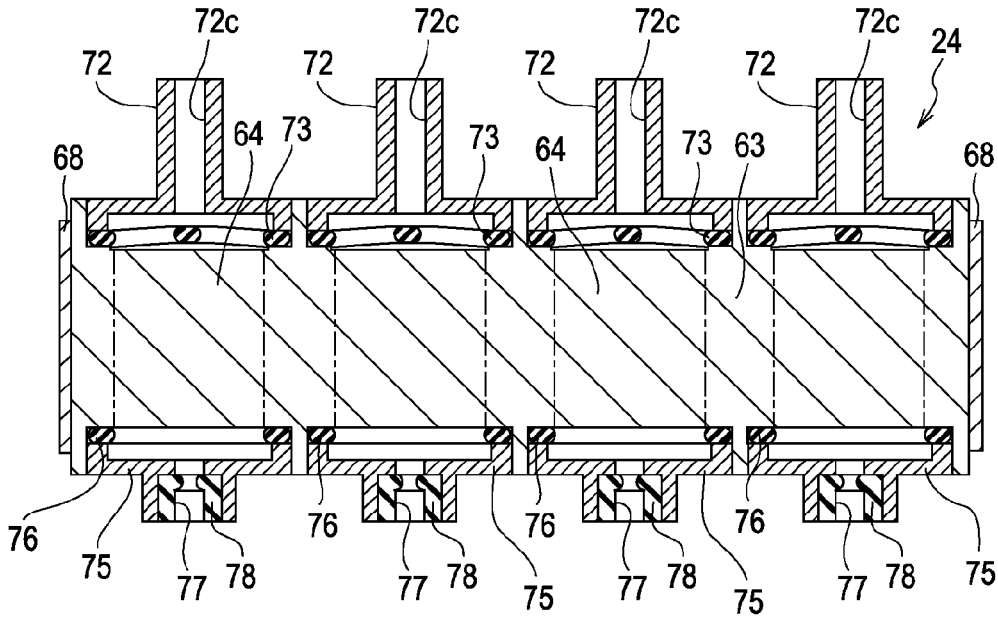
FIG. 7 is a cross-sectional view cut along a line VII-VII in FIG. 5.
Figure 8:
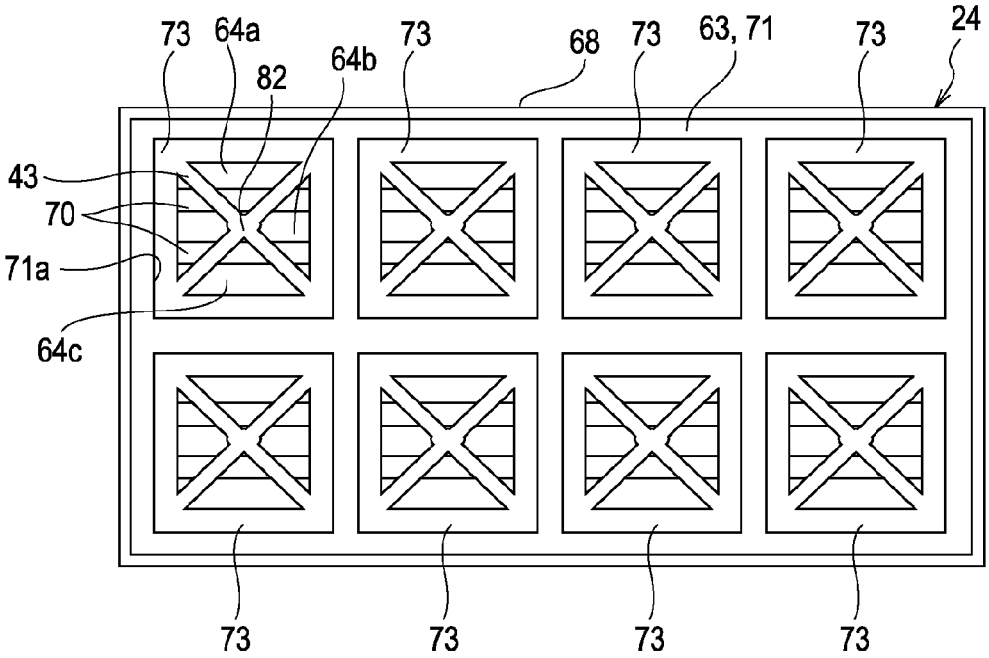
FIG. 8 is a plan view illustrating the heating flow path unit.

FIG. 5 through FIG. 8 are views for explaining an embodiment of the heating flow path unit 24. FIG. 5 is a perspective view illustrating the heating flow path unit 24. FIG. 6 is a cross-sectional view cut along a line VI-VI in FIG. 5. FIG. 7 is a cross-sectional view cut along a line VII-VII in FIG. 5. FIG. 8 is a top view illustrating the heating flow path unit 24 in a state where the first flow path connection joints 72 are not attached.

The heating flow path unit 24 in the embodiment is a hollow member having a box shape. In the heating flow path unit 24, a plurality of liquid flow portions 64 are defined and formed in a unit base body (casing) 63 so as to correspond to the flow paths of the sub tanks 21. It is desirable that the unit base body 63 is formed by a material having high heat conductivity (for example, material having heat conductivity of equal to or higher than 50 W/mk). In the embodiment, the unit base body 63 is formed by a metal such as copper and aluminum. The liquid flow portions 64 are flow paths allowing communication between the flow paths of the sub tanks 21 and the case flow paths 33 of the head unit 20 (head case 32). A dimension of each liquid flow portion 64 in the direction perpendicular to the ink flowing direction is set to be larger than an inner diameter of each head flow path (case flow path 33). In the embodiment, as illustrated in FIG. 8, two rows and four columns of liquid flow portions 64, that is, eight liquid flow portions 64 in total, are defined and formed in the unit base body 63 so as to correspond to the flow paths of the sub tanks 21 and the head flow paths. Each liquid flow portion 64 is divided into a plurality of liquid flow paths in the direction which intersects with the ink flowing direction by dividing walls 70. The dividing walls 70 extend from an inner wall at one side (for example, inner wall at the right side in FIG. 8) to an inner wall at the other side (for example, inner wall at the left side in FIG. 8). In the embodiment, each liquid flow portion 64 is vertically divided into a plurality of liquid flow paths by two dividing walls 70 so that three slit-form liquid flow paths 64*a* to 64*c* in total are formed. It is desirable that the dividing walls 70 are molded integrally with the unit base body 63. If the plurality of dividing walls 70 are provided on the liquid flow portions 64 as described above, contact areas between the unit base body 63 and inks in the liquid flow portions 64 can be increased. Therefore, heat from heaters 68 can be transferred more efficiently.

A partition wall 71 is provided on peripheral edge portions of entrance-side openings of the liquid flow portions 64 on an upper face (face at the side of the sub tanks 21) of the unit base body 63. Note that the entrance-side opening of each liquid flow portion 64 is an opening in a range including individual entrance-side openings of the liquid flow paths 64*a* to 64*c* constituting the same liquid flow portion 64 and corresponds to a common entrance-side opening according to the invention. To be more specific, the partition wall 71 is provided so as to project to the side of the sub tanks in an attached state in a state of surrounding common entrance-side openings. The first flow path connection joints 72 allowing communication between the flow paths of the sub tanks 21 and the liquid flow portions 64 are fitted into first joint attachment portions 71*a* in a state where entrance-side sealing members 73 are interposed therebetween. The first joint attachment portions 71*a* are surrounded by the peripheral edge portions of the common entrance-side openings of the liquid flow portions 64 and the partition wall 71. In the embodiment, eight first flow path connection joints 72 in total are attached to the upper face of the unit base body 63 so as to correspond to the liquid flow portions 64. Each first flow path connection joint 72 is constituted by a tray-form enlarged portion 72*a* and a cylindrical portion 72*b*. A face (lower face) of each enlarged portion 72*a* at the side opposed to the common entrance-side opening of each liquid flow portion 64 is opened in a state where the enlarged portion 72*a* is attached to the unit base body 63. Each cylindrical portion 72*b* is provided so as to project to the side of the sub tank in an attached state from a center portion of an upper face of the enlarged portion 72*a* at the side opposite to the common entrance-side opening.

The cylindrical portions 72*b* are portions which are inserted into the insertion portions 45 when the sub tanks 21 are attached. A connection flow path 72*c* is formed in each cylindrical portion 72*b*. The connection flow paths 72*c* communicate with internal spaces of the enlarged portions 72*a*. Dimensions of each enlarged portion 72*a* in the longitudinal direction (vertical direction in FIG. 8) and the lateral direction (horizontal direction in FIG. 8) when seen from the above are set to be equivalent to or slightly smaller than those of each first joint attachment portion 71*a* in the longitudinal direction and the lateral direction. Further, dimensions of an internal space of each enlarged portion 72*a* in the longitudinal direction and the lateral direction when seen from the above are set to be sufficiently larger than an inner diameter of each connection flow path 72*c* of each cylindrical portion 72*b*. In addition, the dimensions of the internal space of each enlarged portion 72*a* in the longitudinal direction and the lateral direction when seen from the above are set to be equivalent to or slightly larger than those of the common entrance-side opening of each liquid flow portion 64 in the longitudinal direction and the lateral direction. That is to say, it can be said that the inner diameter of each connection flow path 72*c* is enlarged at a position immediately before the liquid flow portion 64 so as to fit to the common flow path opening of the liquid flow portion 64. It is to be noted that the internal space of each enlarged portion 72*a* may be formed into a tapered shape that the inner diameter is gradually increased from the side of each cylindrical portion 72*b* to the side of each exit-side opening. Further, in the embodiment, an exit-side opening of each connection flow path 72*c* of each cylindrical portion 72*b* at the side of the enlarged portion 72*a* corresponds to an exit-side opening at the side of a supply flow path according to the invention. A peripheral edge portion of the exit-side opening of the internal space of each enlarged portion 72*a* corresponds to a peripheral edge portion of the exit-side opening at the side of the supply flow path according to the invention.

Further, the connection flow paths 72*c* formed in the first flow path connection joints 72 in the embodiment constitute a portion of the supply flow path according to the invention. The entrance-side sealing members 73 are arranged between the peripheral edge portions of the exit-side openings (peripheral edge portions of downstream side openings) of the connection flow paths 72*c* and the peripheral edge portions of the common entrance-side openings of the liquid flow portions 64. The connection flow paths 72*c* and the liquid flow portions 64 (liquid flow paths 64*a* to 64*c*) communicate with each other in a liquid-tight state by the entrance-side sealing member 73. The entrance-side sealing members 73 are described in detail later.

On the other hand, a partition wall 74 is provided on peripheral edge portions of common exit-side openings (downstream side openings) of the liquid flow portions 64 on a lower face (face at the side of the head unit 20) of the unit base body 63. To be more specific, the partition wall 74 is provided so as to project in a state of surrounding the common exit-side openings as illustrated in FIG. 6. Further, the second flow path connection joints 75 allowing communication between the liquid flow portions 64 and the introduction flow paths of the recording head 10 are attached to the second joint attachment portions 74*a* in a state where exit-side sealing members 76 are interposed therebetween. The second joint attachment portions 74*a* are surrounded by the peripheral edge portions of the common exit-side openings of the liquid flow portions 64 and the partition wall 74. In the embodiment, eight second flow path connection joints 75 in total are attached to the lower face side of the unit base body 63 so as to correspond to the liquid flow portions 64. Each second flow path connection joint 75 is constituted by a tray-form enlarged portion 75*a* and a cylindrical needle connecting portion 75*b*. A face of the enlarged portion 75*a* at the side opposing to the common exit-side opening of each liquid flow portion 64 is opened in a state where the enlarged portion 75*a* is attached to the unit base body 63. Each needle connecting portion 75*b* is provided so as to project to the side of the recording head 10 in an attached state from a center portion of the face of the enlarged portion 75*a* at the side opposite to the common exit-side opening. A needle insertion portion 77 is formed in each needle connecting portion 75*b*. Each needle insertion portion 77 forms a concave portion at which a portion of a lower face of each needle connecting portion 75*b* (at the side of the recording head 10) is concaved to the side of an upper face thereof (side of the liquid flow portion 64). The concave portion communicates with an internal space of each enlarged portion 75*a*. A packing 78 which elastically makes contact with a side face of each ink introduction needle 44 so as to prevent ink from being leaked is arranged in each concave portion. Each packing 78 is formed into a cylindrical form and is formed by an elastic material such as elastomer.

Dimensions of each enlarged portion 75*a* in the longitudinal direction and the lateral direction when seen from the above are set to be equivalent to or slightly smaller than those of each second joint attachment portion 74*a* in the longitudinal direction and the lateral direction. Further, dimensions of an internal space of each enlarged portion 75*a* in the longitudinal direction and the lateral direction when seen from the above are set to be sufficiently larger than the inner diameter of the flow path in each needle connecting portion 75*b*. In addition, the dimensions of the internal space of each enlarged portion 75*a* in the longitudinal direction and the lateral direction when seen from the above are set to be equivalent to or slightly larger than those of the common exit-side opening of each liquid flow portion 64 in the longitudinal direction and the lateral direction. Lead-out flow paths 75*c* formed in the second flow path connection joints 75 in the embodiment constitute a portion of the introduction flow path according to the invention. The exit-side sealing members 76 are arranged between peripheral edge portions of the entrance-side openings of the second flow path connection joints 75 (peripheral edge portions of upstream side openings) and the peripheral edge portions of the common exit-side openings of the liquid flow portions 64. The exit-side sealing members 76 allow communication between the introduction flow paths and the liquid flow portions 64 (liquid flow paths 64*a* to 64*c*) in the liquid-tight state. Each exit-side sealing member 76 is formed by an elastic material having resistivity against ink such as elastomer and silicon rubber as in the entrance-side sealing members 73, which will be described later.

As illustrated in FIG. 5, the sheet-form heaters 68 are bonded to the side faces of the unit base body 63 over the entire circumference thereof. Each heater 68 is a so-called film heater which seals an electrically heating wire such as a nichrome wire by a band-form insulator having flexibility, for example. In the embodiment, two heaters 68 cover an outer circumference of the unit base body 63. Lead wires 55 are provided on each heater 68. Further, the heating flow path unit 24 makes the heaters 68 generate heat by energizing the electrically heating wires of the heaters 68 through the lead wires 55. Then, the heat of the heaters 68 heats ink passing through the liquid flow portions 64 (liquid flow paths 64*a* to 64*c*) through the structure of the unit base body 63. That is to say, it can be said that the heating flow path unit 24 is a flow path member having a heating function.

If the heating flow path unit 24 configured as described above is attached to the recording head 10 (the upper face of the head unit 20), the ink introduction needles 44 are inserted into the needle insertion portions 77 of the second flow path connection joints 75 so that tips of the ink introduction needles 44 enter the lead-out flow paths 75*c*. With this, the liquid flow portions 64 and the head flow paths are communicated with each other in the liquid-tight state through introduction holes (not illustrated) opened at the tips of the ink introduction needles 44. Further, the sub tanks 21 are attached to the upstream side of the heating flow path unit 24. At this time, the cylindrical portions 72*b* of the first flow path connection joints 72 are inserted into the insertion portions 45 of the sub tanks 21. Therefore, the flow paths in the sub tanks 21 and the liquid flow portions 64 are communicated with each other in the liquid-tight state through the connection flow paths 72*c* of the first flow path connection joints 72. Inks from the side of the sub tanks 21 pass through the liquid flow paths 64*a* to 64*c* of the liquid flow portions 64 from the connection flow paths 72*c* so as to be introduced into the head flow paths of the recording head 10 through the lead-out flow paths 75*c* of the second flow path connection joints 75 and the introduction holes of the ink introduction needles 44. In this case, the inks passing through the liquid flow paths 64*a* to 64*c* of the liquid flow portions 64 are heated by the heat of the heaters 68 through the unit base body 63. With this, ink having high viscosity (to be more specific, ink having viscosity of equal to or larger than 8 mPa·s at 25° C.) such as photocurable ink can be ejected. That is to say, ink is ejected through the nozzles 30 after the viscosity of the ink has been lowered by heating the ink introduced from the sub tanks 21 by the heating flow path unit 24. Therefore, ejection properties (ejection amount, ejection speed, and the like) which are similar to those of normal ink can be obtained. It is needless to say that the invention can be applied to aqueous ink and solvent-type ink having high viscosity other than the photocurable ink.

In the heating flow path unit 24 in the embodiment, the liquid flow paths 64*b* at center portions among the liquid flow paths 64*a* to 64*c* are arranged at positions which are the closest to the exit-side openings of the connection flow paths 72*c*. Therefore, in a configuration to which the invention is not applied, a flow rate of ink flowing through each liquid flow path 64*b* is relatively high in comparison with flow rates of inks flowing through other liquid flow paths 64*a*, 64*c*. As the flow rate of ink is higher, time taken for the ink to pass through each liquid flow path 64*b* becomes shorter than times taken for the inks to pass through other liquid flow paths 64*a*, 64*c*. Therefore, there arises a problem that the inks flowing through the liquid flow paths 64*b* are hard to be sufficiently heated. For example, in a case where the heaters 68 are set to be at 40° C. and ink at a normal temperature (25° C.) is made to flow through the liquid flow paths 64*a* to 64*c* from the side of the sub tanks 21, the ink at 35° C. is fed to the side of the recording head 10. In order to set the temperature of ink introduced to the recording head 10 to 40° C., the temperature of the heaters 68 is required to be increased to about 45° C. As described above, since the set temperature of the heaters 68 and the temperature of ink which passes through the heating flow path unit 24 and is introduced to the recording head 10 are different from each other, the heaters 68 need to generate extra heat. In particular, for example, in a case where an amount of ink ejected from the recording head 10 is relatively large and a flow rate of ink is relatively high (case of so-called high-DUTY) including a case of performing a so-called solid printing, for example, ink is hard to be heated. Note that the solid printing is printing in which a predetermined region on a recording medium such as a recording paper is filled with ink with no space. Therefore, in such case, it is necessary that the temperature of the heaters 68 is set to be higher. However, if the temperature of the heaters 68 is set such that ink becomes an appropriate temperature in the case of the high-DUTY, the following problem arises. That is, if the temperature of the heaters 68 is set in such manner, in a case where an amount of ink ejected from the recording head 10 is relatively small and a flow rate of ink is relatively low (case of so-called low-DUTY) including a case of printing an image and the like of high resolution onto a recording medium, for example, times taken for inks to pass through the liquid flow paths 64*a* to 64*c* become longer. Therefore, there arises a problem that the inks are heated too much more than necessary. In consideration of this point, in the heating flow path unit 24 according to the invention, heat efficiency is improved by making the flow rates of inks passing through the liquid flow paths 64*a* to 64*c* constant by using the entrance-side sealing members 73. Hereinafter, this point is described.

Figure 9:
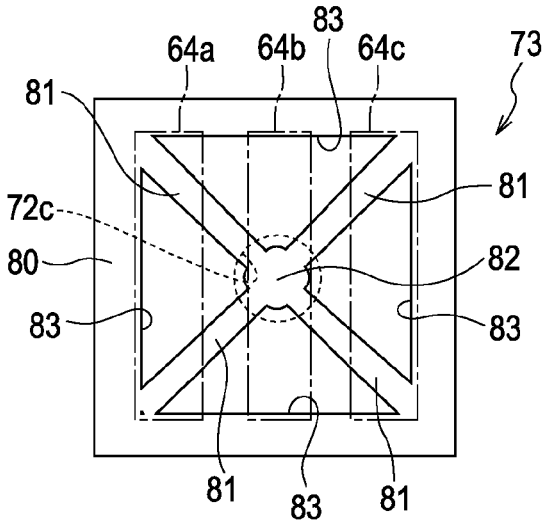
FIG. 9 is a plan view for explaining a configuration of an entrance-side sealing member.

FIG. 9 is a plan view for explaining a configuration of the entrance-side sealing member 73. Further, FIG. 10 is an enlarged cross-sectional view illustrating the main portion of the heating flow path unit 24.

Each entrance-side sealing member 73 is formed by an elastic member having ink resistance, such as elastomer and silicone rubber, for example. The entrance-side sealing member 73 is constituted by a frame portion 80, four beam portions 81, and an inflow restriction portion 82. The frame portion 80 seals the space between the peripheral edge portion of the exit-side opening of the connection flow path 72*c* and the peripheral edge portion of the common entrance-side opening of the liquid flow portion 64. The four beam portions 81 in total extend from corners of the frame portion 80 toward the center. The inflow restriction portion 82 is provided at a portion at which the beam portions 81 intersect with each other at a center portion. Four substantially triangular portions in total each of which is surrounded by the beam portion 81 and the beam portion 81 are hollow portions 83 through which ink can pass. The inflow restriction portion 82 in the embodiment is formed into a substantially circular form when seen from the above. A diameter of the inflow restriction portion 82 is equivalent to or slightly smaller than an inner diameter of the connection flow path 72*c* on the cylindrical portion 72*b* of the first flow path connection joint 72.

Figure 10:
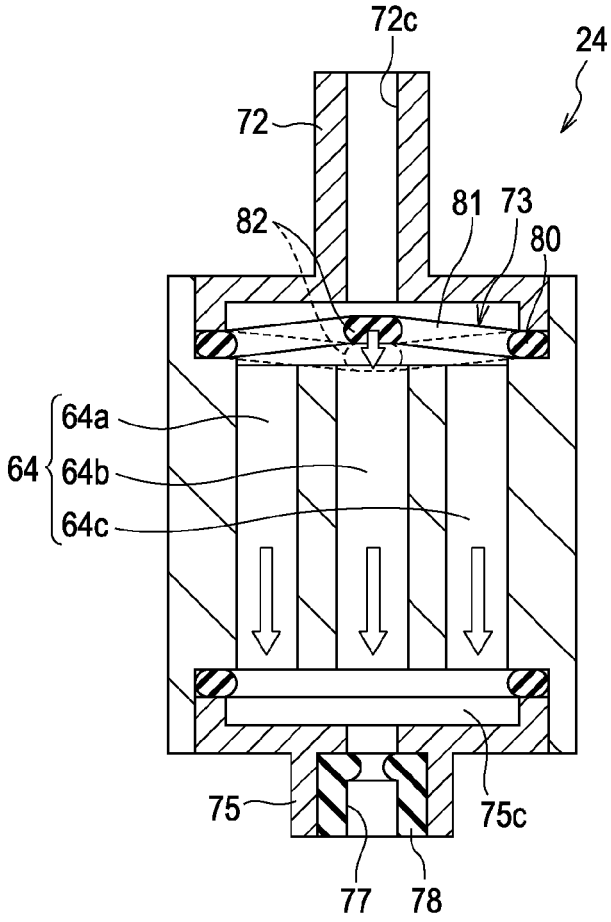
FIG. 10 is an enlarged cross-sectional view illustrating the main portion of the heating flow path unit.

In the embodiment, each beam portion 81 is inclined upward toward the center portion from the side of the frame portion 80 as illustrated in FIG. 10. To be more specific, the beam portion 81 is inclined upward so as to be farther from the common entrance-side opening of the liquid flow portion 64 and be closer to the exit-side opening of the connection flow path 72*c* toward the center portion. Therefore, in a state where the entrance-side sealing member 73 is fitted into and attached to a concave portion of the first joint attachment portion 71*a* and ink does not flow through the liquid flow path 64 (alternatively, a state where the flow rate of ink flowing through the ink liquid flow path 64 is relatively low as in the case of the low-DUTY), the inflow restriction portion 82 is arranged at a position slightly separated from the individual entrance-side opening of the liquid flow path 64*b* at a center portion among the liquid flow paths 64*a* to 64*c* to the side of the exit-side opening of the connection flow path 72*c*. If the inflow restriction portion 82 is arranged between the individual entrance-side opening of the liquid flow path 64*b* and the exit-side opening of the connection flow path 72*c* in such manner, a flowing direction of ink flowing out from the exit-side opening of the connection flow path 72*c* is once changed to a plane direction of the entrance-side sealing member 73 by the inflow restriction portion 82, and then, the ink flows into each of the liquid flow paths 64*a* to 64*c*. Therefore, the ink from the exit-side opening of the connection flow path 72*c* becomes difficult to flow into the liquid flow path 64*b* in which flow rate tends to be relatively high when no measures are taken. On the other hand, the ink becomes relatively easy to flow into the liquid flow paths 64*a*, 64*c* arranged at positions distanced from the exit-side opening of the connection flow path 72*c*. That is to say, the inflow restriction portion 82 restricts an amount of ink flowing into the liquid flow path 64*b*. Therefore, differences in flow rates of inks flowing through the liquid flow paths 64*a* to 64*c* are reduced. Accordingly, the temperature of the heaters 68 are not required to be set higher more than necessary and the ink can be efficiently heated.

Further, the inflow restriction portion 82 in the embodiment is configured so as to be closer to or be separated from the individual entrance-side opening of the liquid flow path 64*b* in accordance with a flow rate of ink. That is to say, in the case of the low-DUTY in which flow rate of ink is relatively low, as illustrated by solid lines in FIG. 10, the inflow restriction portion 82 is positioned to be slightly separated from the individual entrance-side opening of the liquid flow path 64*b* to the side of the exit-side opening of the connection flow path 72*c*. On the other hand, in the case of the high-DUTY in which flow rate of ink is relatively high, as illustrated by dashed lines in FIG. 10, the inflow restriction portion 82 is pushed to the downstream side by flow of ink so as to be closer to the individual entrance-side opening of the liquid flow path 64*b*. With this, the inflow restriction portion 82 closes a part of the individual entrance-side opening of the liquid flow path 64*b*. That is to say, as the flow rate of ink is lower, ink is easy to flow into the liquid flow path 64*b*. On the other hand, as the flow rate of ink is higher, ink is difficult to flow into the liquid flow path 64*b*. Therefore, differences in flow rates of inks flowing through the liquid flow paths 64*a* to 64*c* are further reduced regardless of a level of the entire ink flow rate. Accordingly, ink can be heated more efficiently.

The invention is not limited to the above embodiment and various modifications can be made based on description of the scope of the invention.

Figure 11:
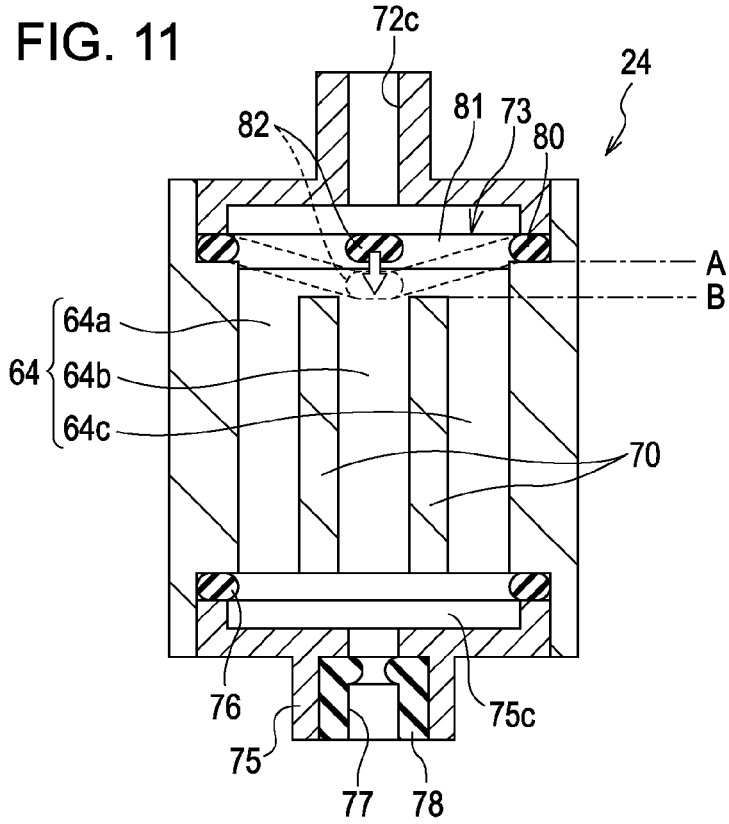
FIG. 11 is an enlarged cross-sectional view illustrating the main portion of a heating flow path unit according to a second embodiment.

FIG. 11 is a cross-sectional view illustrating the main portion of the heating flow path unit 24 for explaining a configuration according to a second embodiment of the invention. In the above first embodiment, as for each entrance-side sealing member 73, a configuration in which the beam portions 81 are inclined upward toward the center portion from the side of the frame portion 80 so that the inflow restriction portion 82 is arranged at a position slightly separated from the individual entrance-side opening of the liquid flow path 64*b* to the side of the exit-side opening of the connection flow path 72*c* has been described as an example. However, a configuration of each entrance-side sealing member 73 is not limited thereto. The embodiment is different from the above first embodiment in the following points. That is, in the embodiment, the frame portion 80, the beam portions 81, and the inflow restriction portion 82 of the entrance-side sealing member 73 are formed into shapes of being aligned on the same plane. Further, in the embodiment, end faces (position indicated by B in the FIG. 11) of the dividing walls 70 at the upstream side (entrance-side) are displaced to the downstream side with respect to a face on which the entrance-side sealing member 73 is placed on the peripheral edge portion of the common entrance-side opening. With this, the inflow restriction portion 82 is arranged at a position slightly separated from the individual entrance-side opening of the liquid flow path 64*b* to the side of the exit-side opening of the connection flow path 72*c*. With the configuration, the inflow restriction portion 82 can be also configured so as to be closer to or be separated from the individual entrance-side opening of the liquid flow path 64*b* in accordance with a flow rate of ink.

Figure 12:
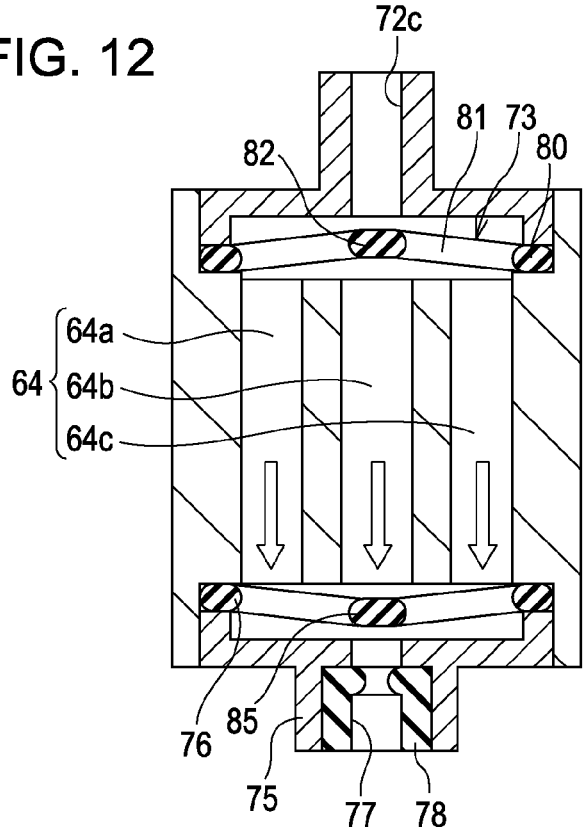
FIG. 12 is an enlarged cross-sectional view illustrating the main portion of a heating flow path unit according to a third embodiment.

FIG. 12 is a cross-sectional view illustrating the main portion of the heating flow path unit 24 for explaining a configuration according to a third embodiment of the invention. In the above first embodiment, the configuration in which only the entrance-side sealing member 73 has the inflow restriction portion 82 has been described as an example. However, the configuration is not limited thereto. In the embodiment, the exit-side sealing member 76 is set to have a dimension and a shape which are the same as those of the entrance-side sealing member 73. Further, the exit-side sealing member 76 is arranged between the peripheral edge portion of the entrance-side opening of the second flow path connection joint 75 and the peripheral edge portion of the common exit-side opening of the liquid flow path 64 in a posture obtained by inverting the entrance-side sealing member 73 in the vertical direction. Further, in this configuration, as a material of the entrance-side sealing member 73 and the exit-side sealing member 76, it is desirable that a material having rigidity higher than that as illustrated in the above first embodiment is employed. In this configuration, on the exit-side sealing member 76, a portion corresponding to the inflow restriction portion 82 of the entrance-side sealing member 73 functions as an outflow restriction portion 85 which restricts flow-out of ink from an individual entrance-side opening of the liquid flow path 64*b*. The outflow restriction portion 85 is arranged at a position slightly separated from the individual exit-side opening of the liquid flow path 64*b* at the center portion among the liquid flow paths 64*a* to 64*c* to the side of the needle insertion portion 77 in a state where ink does not flow through the liquid flow path 64. With this, flow of ink flowing through the liquid flow path 64*b* can be controlled by the inflow restriction portion 82 of the entrance-side sealing member 73 and the outflow restriction portion 85 of the exit-side sealing member 76. It is to be noted that even if the inflow restriction portion 82 and the outflow restriction portion 85 displace little unlikely in the above first embodiment, if ink flowing into the flow-through flow path 64*b* is restricted, differences in flow rates of inks flowing through the liquid flow paths 64*a* to 64*c* are reduced. Therefore, effects which are the same as those obtained in the above first embodiment can be obtained.

Figure 13:
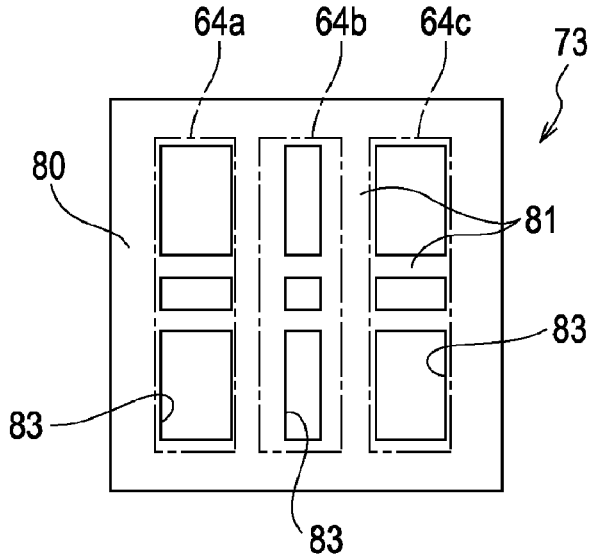
FIG. 13 is a plan view for explaining a configuration of an entrance-side sealing member according to a modification.

FIG. 13 is a plan view for explaining an entrance-side sealing member 73 according to a modification.

On the entrance-side sealing member 73 as illustrated in FIG. 13, the beam portions 81 in the longitudinal and lateral directions are intersected with each other in a grid form so that the hollow portions 83 are formed. Further, the sizes (opening areas) of the hollow portions 83 corresponding to the liquid flow paths 64*a* to 64*c* are made different from each other. To be more specific, opening areas of the hollow portions 83 corresponding to the individual entrance-side opening of the liquid flow path 64*b* at the center portion among the liquid flow paths 64*a* to 64*c* are made smaller than opening areas of the hollow portions 83 corresponding to the individual entrance-side openings of the liquid flow paths 64*a*, 64*b*. Therefore, the beam portions 81 forming the hollow portions 83 corresponding to the individual entrance-side opening of the liquid flow path 64*b* at the center portion function as inflow restriction portions which restrict ink from flowing into the liquid flow path 64*b*. In other words, the entrance-side sealing member 73 having various shapes can be employed as long as the entrance-side sealing member 73 has an inflow restriction portion which restricts ink from flowing into the liquid flow path 64*b*. Further, the same holds true for the exit-side sealing member 76.

Figure 14:
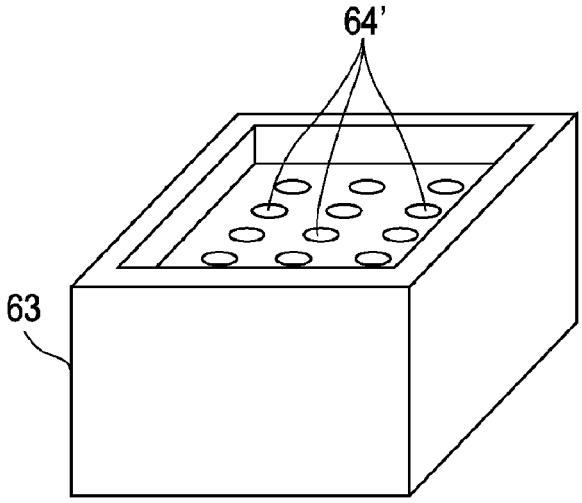
FIG. 14 is a perspective view for explaining a heating flow path unit according to the modification.

Further, in the above first embodiment, the liquid flow paths 64*a* to 64*c* of the heating flow path unit 24, which are defined by the dividing walls 70 and formed into a slit form, have been described as an example. However, the liquid flow paths 64*a* to 64*c* are not limited thereto. For example, as illustrated in FIG. 14, a configuration in which a plurality of cylindrical liquid flow paths 64' which penetrate through the unit base body 63 in the height direction are arranged in a matrix form can be employed. With this configuration, the same action effects as those obtained in the above first embodiment can be also obtained by arranging the inflow restriction portion of the entrance-side sealing member 73 on individual entrance-side openings of liquid flow paths in which flow rate of ink is relatively high among the liquid flow paths 64'.

Further, in the above first embodiment, a configuration in which the heaters 68 are bonded to the outer circumference of the unit base body 63 has been described as an example. The invention is not limited to the configuration. For example, a configuration in which the heaters 68 are provided so as to be embedded in walls (in the dividing walls 70) of the unit base body 63 can be also employed. With this configuration, ink can be heated more directly. This makes it possible to further improve the heat efficiency.

It is to be noted that, in the above embodiment, a configuration of a so-called OFF carriage type in which ink from the side of the printer main body is received by the sub tanks 21, and then, is introduced to the head flow paths has been described as an example. However, it is needless to say that the invention can be applied to a configuration of an ON carriage type. That is to say, a configuration in which ink cartridges (liquid storage members) storing inks are accommodated in the accommodation hollow portion 47 instead of the above sub tanks 21 (liquid introduction members) is also preferable.

Further, the invention can be also applied to liquid ejecting heads mounted on a display manufacturing apparatus, an electrode manufacturing apparatus, a chip manufacturing apparatus, a micropipette, and the like as long as the liquid ejecting heads use liquid required to be heated.

What is claimed is:

1. A heating flow path unit which is arranged between a liquid supply source and a liquid ejecting head and heats liquid to be supplied to the side of the liquid ejecting head by a heater comprising:

a plurality of liquid flow paths which are formed so as to be in parallel in a direction intersecting with a flowing direction of liquid in a unit base body and allow communication between a supply flow path from the side of the liquid supply source and an introduction flow path to the side of the liquid ejecting head; and an entrance-side sealing member which is arranged between a peripheral edge portion of an exit-side opening at the side of the supply flow path and a peripheral edge portion of a common entrance-side opening which is common to the liquid flow paths and connects the exit-side opening at the side of the supply flow path and the common entrance-side opening in a liquid-tight state, wherein the entrance-side sealing member has an inflow restriction portion which restricts flow of liquid on a portion corresponding to an individual entrance-side opening of a liquid flow path in which flow rate is relatively high among the liquid flow paths.

2. The heating flow path unit according to claim 1, wherein the inflow restriction portion is arranged so as to be separated from the individual entrance-side opening in a state where liquid does not flow through the liquid flow paths and is closer to or is separated from the individual entrance-side opening in accordance with a flow rate of liquid.

3. A liquid ejecting head which introduces liquid from a liquid supply source through an introduction flow path and is capable of ejecting the introduced liquid through nozzles, comprising the heating flow path unit according to claim 2 in a detachable manner.

4. The heating flow path unit according to claim 1, further including an exit-side sealing member which is arranged between a peripheral edge portion of a common exit-side opening which is common to the liquid flow paths and a peripheral edge portion of an entrance-side opening at the side of the introduction flow path and connects the common exit-side opening and the entrance-side opening at the side of the introduction flow path in a liquid-tight state, wherein the exit-side sealing member has an outflow restriction portion which restricts flow of liquid on a portion corresponding to an individual exit-side opening of a liquid flow path in which flow rate is relatively high among the liquid flow paths.

5. A liquid ejecting head which introduces liquid from a liquid supply source through an introduction flow path and is capable of ejecting the introduced liquid through nozzles, comprising the heating flow path unit according to claim 4 in a detachable manner.

6. A liquid ejecting head which introduces liquid from a liquid supply source through an introduction flow path and is capable of ejecting the introduced liquid through nozzles, comprising the heating flow path unit according to claim 1 in a detachable manner.

* * * * *